United States Patent [19]

McKinney et al.

[11] Patent Number: 4,975,325

[45] Date of Patent: Dec. 4, 1990

[54] SELF CRIMPABLE NYLON 66 CARPET YARN

[75] Inventors: Stanley E. McKinney; Frank Stutz; Chester C. Wu; Jing-peir Yu, all of Pensacola, Fla.

[73] Assignee: Monsanto Company, Pensacola, Fla.

[21] Appl. No.: 212,999

[22] Filed: Jun. 29, 1988

[51] Int. Cl.[5] ..... D02G 3/00

[52] U.S. Cl. ..... 428/371; 428/364; 428/369; 428/373

[58] Field of Search ..... 428/373, 369, 371, 364, 428/401; 528/342, 335; 264/168; 57/243

[56] References Cited

U.S. PATENT DOCUMENTS

| | | | |
|---|---|---|---|
| 2,957,747 | 10/1960 | Bowling . | |
| 3,304,289 | 2/1967 | Ballentine et al. | 528/342 |
| 3,987,136 | 10/1976 | Schippers | 264/103 |
| 4,069,657 | 1/1978 | Bascom et al. | 264/103 X |
| 4,238,439 | 12/1980 | Hyun | 264/168 |
| 4,244,907 | 1/1981 | Wu | 264/168 |
| 4,343,860 | 8/1982 | Feinstrom et al. | 428/371 |
| 4,583,357 | 4/1986 | Chamberlin et al. | 57/243 |
| 4,601,949 | 7/1986 | Bach et al. | 428/374 |
| 4,721,650 | 1/1988 | Nunning | 428/369 |
| 4,816,550 | 3/1989 | Stutz et al. | 528/335 |

*Primary Examiner*—Lorraine T. Kendell
*Attorney, Agent, or Firm*—John W. Whisler

[57] ABSTRACT

A melt-spinning process for producing self-crimping, nylon 66 carpet yarn at spinning speeds of, for example 4000 meters per minute is provided. The process utilizes polymer having a relative viscosity (RV) of at least 50 and containing a sufficient amount of a chain branching agent to prevent broken filaments and to provide yarn having good luster.

12 Claims, 1 Drawing Sheet

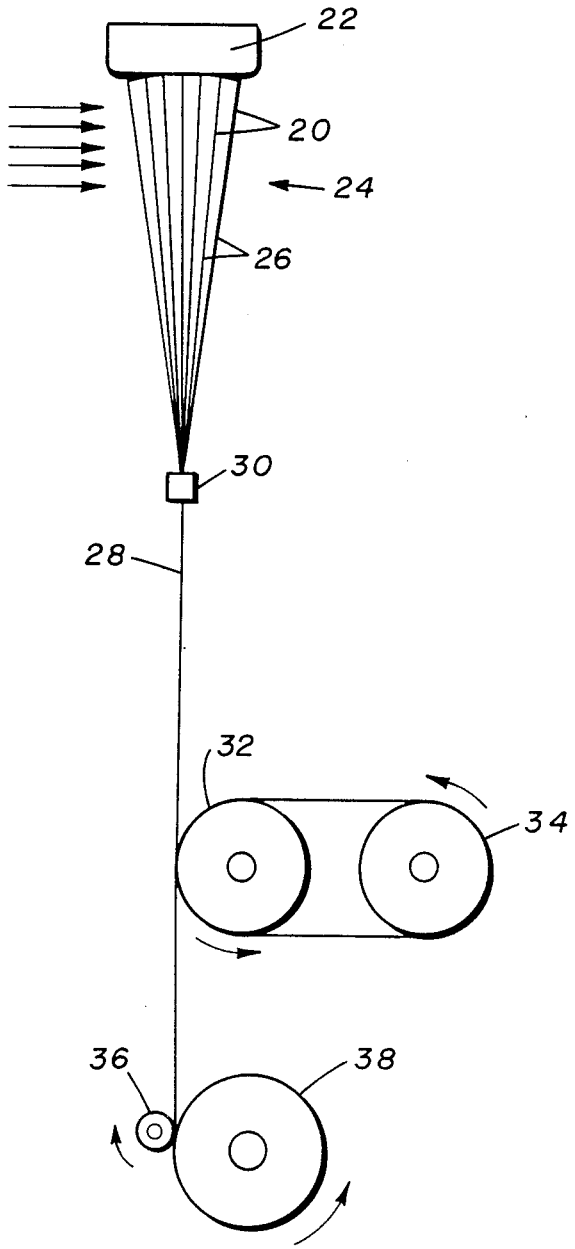
22
20
24
26
30
28
32
34
36
38

SELF CRIMPABLE NYLON 66 CARPET YARN

BACKGROUND OF THE INVENTION

This invention relates to a high-speed, melt-spinning process for producing self-crimpable, nylon 66 carpet yarn and to the yarn produced thereby.

The term "high-speed", as used herein, means a speed of at least 2300 meters per minute (mpm).

The term "self-crimpable" yarn, as used herein, means a yarn which when subjected to 180.C. dry heat for five minutes while under no tension develops a helical crimp.

The term "carpet yarn", as used herein, means a yarn having an elongation-to-break ($E_b$) of less than 120%, a total denier of at least 750 and an average denier per filament (dpf) of at least 13.

The term nylon 66, as used, means a fiber-forming polymer consisting essentially of repeating units of the formula:

$$-NH(CH_2)_6NHC(=O)(CH_2)_4C(=O)-.$$

It is understood that the polymer may contain minor amounts of additives such as dye adjuvants, delustrants, stabilizers, and the like commonly employed in the art.

Nylon 66 carpet yarn having good luster is conventionally produced by low-speed, melt-spinning processes in which molten nylon 66 is extruded through orifices of a spinneret to form molten streams that are quenched (solidified) by means of a cross-flow of air in a quenching chamber, commonly referred to as a chimney, to form filaments that are converged on a guide to provide an as-spun yarn. A liquid finish is then applied to the yarn and the yarn is either collected at a speed of 400 to 800 mpm and subsequently drawn several times (e.g. 3.5 times) its length in a separate operation or drawn in-line before being collected. The drawn yarn is then crimped by conventional means, for example, by air-jet texturing, gear-crimping, or stuffer box crimping, either in-line during the melt-spinning process or subsequent thereto in a separate operation. It would be economically desirable to provide a high-speed, melt-spinning process for producing a self-crimpable, monocomponent nylon 66 carpet yarn having good luster in which the extra drawing and crimping steps are eliminated.

U.S. Pat. No. 2,957,747 describes a melt spinning process for producing self-crimpable nylon 66 apparel yarn in which high spinning speeds are utilized. However, when one attempts to use high spinning speeds in conventional melt spinning processes to produce nylon carpet yarn which has a large number of large denier filaments, several problems are encountered. One problem encountered is that the filaments are whipped about in the chimney to a much greater extent and the likelihood that molten streams will come into contact with and stick (fuse) to one another in the chimney is greatly increased. Another problem is that the larger denier filaments simply do not cool sufficiently to prevent filaments from sticking to one another on the convergence guide. Fused filaments ultimately lead to broken filaments which cause wraps and other processing difficulties, particularly in cabling operations. Broken filaments also can distract from the aesthetics of the yarn and carpets made therefrom. Also, if the level of fused and/or broken filaments becomes too high during melt-spinning, the yarn cannot be collected in an orderly fashion.

Yet another problem encountered is that conventional nylon 66 carpet yarn spun at high speeds has low (poor) luster, i.e. is dull.

U.S. Pat. No. 4,238,439 describes a high-speed, melt-spinning process for producing self-crimpable carpet yarn utilizing a nylon 66 copolymer. However, carpet yarn described therein does not have good luster and requires the use of a copolymer which is more complicated to make than nylon 66.

SUMMARY OF THE INVENTION

The present invention provides a high-speed, melt-spinning process for producing self-crimpable nylon 66 carpet yarn having (good) high luster, as evidenced by having a Luster Test Value (hereinafter defined) of at least 85%, and an acceptable number of broken filaments. The process comprises the steps of:

(a) extruding molten polymer 66 nylon downwardly through a spinneret having at least 35 non-round orifices at a rate of at least 3.3 grams per orifice per minute into a quenching zone to form a number of molten streams corresponding to the number of said orifices;

(b) quenching said molten streams as they move away from said spinneret with a cross-flow of cooling air to form filaments;

(c) withdrawing said filaments from said molten streams at a velocity (spinning speed) of at least 2300 meters per minute;

(d) converging said filaments to form a yarn;

(e) applying a liquid finish to said yarn; and (f) collecting said yarn in an orderly fashion;

said polymer being characterized in having a relative viscosity (RV) of at least 50 and containing a sufficient amount of a chain branching agent to prevent said molten streams from sticking to one another and to provide yarn having a Luster Test Value of at least 85% and wherein said extrusion rate, velocity of the cooling air and spinning speed are selected such that the yarn has a denier per filament of at least 13, an $E_b$ of less than 120% and a Bulk Test Value of at least 10%.

The term "Bulk Test Value", as used herein, means bulk developed and/or retained during performance of the bulk test hereinafter defined.

Carpet yarns prepared by the process of this invention are characterized in having: (a) a Luster Test Value of at least 85%; (b) a Bulk Test Value of at least 10%; and (c) a SAXS equatorial/meridional ratio of at least 0.6. (Carpet yarns spun at low speeds have a SAXS ratio of less than 0.6.) Of course, the luster of yarns of the present invention may be reduced by incorporating a delustrant such as $TiO_2$ into the yarn. The term "Luster Test Value", as used herein means luster measured by performance of the luster test hereinafter defined.

BRIEF DESCRIPTION OF THE DRAWING

The FIGURE is a schematic front elevation view of a preferred apparatus for practicing the process of this invention.

DETAILED DESCRIPTION OF THE PREFERRED EMBODIMENTS OF THE INVENTION

Preferably, the process is carried out under conditions providing carpet yarn having a Bulk Test Value in the range of 12% to 45%, an $E_b$ of at least 30% and less than 90% and most preferably in the range of 35% to 65%, and an acceptable number of broken filaments.

In carrying out the high-speed process of this invention nylon 66 polymer is used which in the molten state has an RV of at least 50 and contains sufficient chain branching agent such that the the molten streams do not stick to one another and so as to provide yarn having good luster as evidenced by having a Luster Test Value of at least 85% and, preferably, at least 95%. Normally, if the polymer does not contain chain branching agent, the RV must be be in excess of about 90. However, by incorporating chain branching agent into the polymer, polymer having an RV in the range of 50 to 90 can be used. Generally, the amount of chain branching agent that must be incorporated into polymer having an RV in the 60 to 90 range in order to prevent sticking of the molten streams and to provide yarn of good luster will be in the range of 0.02 mole % to 0.5 mole %, based on the theoretical moles of polymer repeat units. By "theoretical moles of polymer repeat units" is meant moles of polymer repeat units theoretically formed based on moles of monomer used. The chain branching agent may be added to the monomers prior to polymerization or to the molten polymer prior to extrusion. A suitable chain branching agent which may be used in practicing the invention is 4(aminomethyl)1,8-diamino octane (referred to herein as "TAN").

In a preferred embodiment of the invention, the process is carried out using the equipment arrangement shown in FIG. 1. Referring to FIG. 1, molten nylon 66 polymer having an RV in the range of 70 to 120 and containing from 0 to 0.5 mole %, based on the theoretical moles of polymer repeat units, of chain branching agent is extruded downwardly through non-round orifices of spinneret 22 at a rate of at least 3.3 grams per minute per orifice to form a plurality of molten streams 26. Molten streams 20 are quenched to form filaments 26 by means of a cross-flow of quenching air in quench zone 24 below spinneret 22. Filaments 26 are withdrawn from their corresponding molten streams and converged into yarn 28 at spin finish applicator 30 located a given distance below spinneret 22. Yarn 28 passes with a plurality of wraps around driven roll 32 and driven roll 34 prior to being wound onto bobbin 38 by winder 36. Rolls 32 and 34 are operated at a peripheral speed of at least 2300 meters/min. and, preferably, at least 3500 meters/min. Winder 36 is operated at a peripheral speed sufficient to provide a proper winding tension as yarn 28 is being wound onto bobbin 38. Normally, the peripheral speed of roll 34 is slightly less than the peripheral speed of winder 36, thereby permitting yarn 28 to relax before being wound onto bobbin 38, otherwise, relaxation of yarn 28 would crush the bobbin. However, yarn 28 must be under sufficient winding tension to keep it from sluffing off bobbin 38.

In carrying out the process, the extrusion rate in terms of grams per minute per orifice (i.e. filament) is selected in conjunction with the spinning speed (speed of the feed roll) to achieve filaments of the desired carpet dpf. The spinning speed is selected to provide yarn of desired bulk and elongation-tobreak. The RV and chain branching agent content of the nylon 66 polymer are selected to provide sufficient stress in the molten streams to eliminate broken filaments in the yarn and to provide yarn having a Luster Test Value of at least 85%. In general, polymer is used having an RV as low as possible while still eliminating broken filaments since polymer having an RV in excess of about 80 creates melt handling filtration problems in commercial scale operations.

MEASUREMENTS

The yarn elongation-to-break ($E_b$) is measured one week after spinning. Yarn packages to be tested are conditioned at 21 degrees C. and 65% relative humidity for one day prior to testing. Fifty yards of yarn are stripped from the bobbin and discarded. Elongation-to-break is determined using an Instron tensile testing instrument. The gauge length (initial length) of yarn sample between clamps on the instrument is 25 cm., and the crosshead speed is 30 cm. per minute. The yarn is extended until it breaks. Elongation-to-break is defined as the increase in sample length at the time of yarn breakage, expressed as a percentage of the original gauge length (25 cm.).

Relative viscosity (RV) is determined by ASTM D789-81, using an appropriate viscometer and a solution equivalent to 11.0 grams of the nylon 66 polymer in 100 ml of 90% formic acid with the RV being the ratio of the absolute viscosity of the polyamide solution to that of the 90% formic acid.

Bulk and Shrinkage are determined by the following procedures. The yarn is conditioned at 23° C. and 72% relative humidity for one day prior to testing. Twenty five meters of yarn are stripped from the surface of the bobbin and discarded. Using a Suter denier reel or equivalent and a winding tension of 0.033 grams per yarn denier, the yarn is wound into a skein having a 1.125 meter circumference and a skein denier of approximately (but not to exceed) 55,000 skein denier. For example, if the yarn denier is 520, 52 revolutions of the denier reel will provide a skein denier of 54,080 while 53 revolutions would provide a skein denier of 55,120. In this instance 52 revolutions would be used. The ends of the skein are tied together while maintaining the 0.033 grams per denier tension, and the skein is removed from the denier reel and suspended form a ½ inch (12.7 mm) diameter rod. A number 1 paper clip, bent into an "S" shape is suspended from the skein. The rod with skein and paper clip attached is placed in a 180.C forced hot air oven sufficiently large that the skein hangs freely. After 5 minutes in the oven, the rod with skein and paper clip is removed from the oven and hung in an atmosphere of 23° C. and 72% relative humidity for one minute. After 30 seconds, the skein length in centimeters is measured with no weight attached thereto and recorded as L1. A weight equal to 0.0009 grams per skein denier is then gently suspended from the paper clip. After 30 seconds, the skein length in centimeters is measured and recorded at L2. The Bulk Test Value, expressed in terms of percent (%), is then defined as $(100)(56.25-L2)/56.25$. Percent bulk under no load is defined as $L(100)(56.25-L1)/56.25$ and retraction ratio is defined as $56.25-L1/(56.25-L2)$.

The X-ray diffraction patterns (small angle X-ray scattering, or SAXS) are recorded on NS54T Kodak no-screen medical X-ray film using evacuated flat plate Laue cameras (Statton type). Specimen to film distance is 32.0 cm.; incident beam collimator length is 3.0 inches, exposure time is 8 hours. Interchangeable Statton type yarn holders with 0.5 mm. diameter pinholes and 0.5 mm yarn sheath thickness are used throughout as well as 0.5 mm entrance pinholes. The filaments of each sheath of yarn are aligned parallel to one another and perpendicular to the X-ray beam. A copper fine focus X-ray tube ($\lambda=1.5418A$) is used with a nickel filter at 40 KV and 26.26 MA, 85% of their rated load. For each X-ray exposure a single film is used in the film cassette. This film is evaluated on a scanning P-1000 Obtronics Densitometer for information concerning scattering intensity and discrete scattering distribution characteristics in the equatorial and meridional directions. A curve fitting procedure, using Pearson VII functions [see H. M. Heuvel and R. Huisman, J. Appl. Poly. Sci., 22, 2229–2243 (1978)]together with a second order polynomial background function, is used to fit the experimental data prior to calculation. A meridional scan is performed, the discrete scattering fitted, equatorial scans are performed through each discrete scattering maxima and then again the data is fitted via a parameter fit procedure.

The SAXS discrete scattering X-ray diffraction maxima are used to determine the average lamellar dimensions. In the meridional direction this is taken here to be the average size of the lamellar scattered in the fiber direction and in the equatorial direction, the average size of the lamellar scattered in a direction perpendicular to the fiber direction. These sizes are estimated from the breadth of the diffraction maxima using Scherrer's methods, $$D(meridional\ or\ equatorial)=K\lambda/\beta cos\theta.$$

where K is the shape factor depending on the way $\beta$ is determined, as discussed below, $\lambda$ is the X-ray wave length in this case 1.5418 angstroms, $\theta$ is the Bragg angle, and $\beta$ the spot width of the discrete scattering in radians.

$$\beta(meridional)=2\theta_D-2\theta\beta$$

where $2\theta_D(radians)=Arctan(HW+w)/2r)$ $2\theta\beta(radians)=Arctan(HW+w)/2r)$ r= the fiber to film distance 320 mm.

w=the corrected half width of the scattering as discussed below

HW=peak to peak distance (mm.) between discrete scattering maxima

The Scherrer equation is again used to calculate the size of the lamellar scattered in the equatorial direction through the discrete scattering maxima, $$\beta(equatorial)=2\ Arctan(w/2r^*)$$

where $r^*=[(HW/2)^2+(320)^2]^{\frac{1}{2}}$.

Warren's correction for line broadening due to instrumental effects is used as a correction for Scherrer's line broadening equation, $$W_m^2=W^2+w^2$$

where $W_m$ is the measured line width, W=0.39 mm. is the instrumental contribution obtained from inorganic standards, and w is the corrected line width (either in the equatorial or meridional directions) used to calculate the spot width in radians, $\beta$. The measured line width $W_m$ is taken as the width at which the diffraction intensity on a given film falls to a value of one-half the maximum intensity and is the half width parameter of the curve fitting procedure. Correspondingly, a value of 0.90 is employed for the shape factor K in Scherrer's equations. Any broadening due to variation of periodicity is neglected.

The SAXS equatorial/meridional ratio (EW/MW) is equal to D(equatorial)/D(meridional).

Luster is measured by the following procedure using a commercially available Hunterlab Model D-16 Glossmeter. Yarn samples are prepared for testing by winding sufficient yarn around an 18 gauge aluminum card measuring 3½ by 4 inches to obscure the card using a winding tension of 44 grams. (A AVC master winder available from Manufacture Engineering Corp., Hatbora, Pa, can be used for this purpose). The card is then placed on the Glossmeter with yarn in parallel position to the Glossmeter and the Glossmeter is set to read % Contrast Luster. A reading ($R_1$) is made and recorded. The card is rotated 180° and a second reading ($R_2$) is made and recorded. The card is then inverted and a third reading ($R_3$) is made and recorded. The card is then rotated 180° C. an a fourth reading ($R_4$) is made and recorded. The average of the four readings is calculated and reported as % Luster.

The following example is given to further illustrate the invention.

EXAMPLE

This example illustrates preparation of self-crimpable nylon 66 carpet yarn in accordance with the process of the present invention.

A series of runs are carried out in which yarns having a total denier of 1156 are prepared using the arrangement of equipment shown in FIG. 1. In each run, nylon 66 polymer is spun at a temperature of 295° C. TAN (0.1 mole %) is incorporated into the polymer used to make certain of the yarns as specified in the Table that follows. Spinneret 22 has 68 orifices, all of which are either of a trilobal (T) or pentalobal (P) cross-section as specified in the Table. Finish applicator 30 is positioned about 300 cm below the spinneret. A cross-flow of room temperature quench air is supplied in quench zone 24. The yarn makes 3 wraps around rolls 32 and 34. The peripheral speed of Rolls 32 and 34 is 4000 meters per minute. The extrusion rate is 7.55 grams of polymer per orifice per minute. The yarn is collected on bobbin 38 at a speed slightly less than the spinning speed (i.e. the peripheral speed of feed roll 32). Other processing conditions are varied from yarn to yarn as specified in the Table in order to determine the effect thereof on the properties of the yarn. In each instance the bulk, luster and elongation ($E_b$) are determined and the bobbin is visually inspected for the presence of broken filaments. The results of the determinations and inspections are also given in the Table. The SAXS equitorial/meridional ratio EW/MW), when measured, is also given in the Table.

TABLE

| Item | Fiber X-Section | RV | % TAN | % Bulk | % Luster | % $E_b$ | Broken Filaments | SAXS EW/MW |
|---|---|---|---|---|---|---|---|---|
| A | P | 64.5 | 0 | 41.3 | 62.3 | 79.2 | Yes | 0.69 |
| B | P | 70.8 | 0.1 | 26.4 | 96.1 | 70.0 | None | — |
| C | P | 74.4 | 0 | 39.9 | 72.4 | 78.6 | Yes | — |
| D | P | 73.4 | 0.1 | 29.2 | 92.9 | 73.0 | None | — |
| E | P | 83.3 | 0 | 39.4 | 77.7 | 78.1 | Yes | 0.78 |
| F | T | 80.1 | 0.1 | 23.1 | 93.4 | 62.6 | None | 1.21 |

TABLE -continued

| Item | Fiber X-Section | RV | % TAN | % Bulk | % Luster | % $E_b$ | Broken Filaments | SAXS EW/MW |
|---|---|---|---|---|---|---|---|---|
| G | P | 100.8 | 0 | 32.6 | 88.1 | 74.1 | None | 0.96 |

Items B, D, F and G represent yarns of the present invention and differ from Items A, C and E in having high luster (i.e. a value of at least 85%) and being free of broken filaments. Item D differs from Item C and Item F from Item E in that Items D and F contain TAN, whereas Items C and E do not. It will be noted that Items A, C and E lack luster and contain a large number of broken filaments. It will also be noted that Item G has an RV high enough so that a yarn having high luster and no broken filaments is obtained without incorporating TAN into the polymer.

Yarns spun at low speeds have a EW/MW value less than 0.60.

While the above example uses TAN for exemplifying the invention, numerous other branching agents may be used. Bishexamethylene triamine and alpha-amino-epsilon-caprolactam are alternative branching agents. Trimesic acid is an example of a material reactive with amine end groups in the polymer. Any necessary adjustment in the amount of branching agent can readily be done by trial and error. Suitable branching agents generally contain three or more functional groups reactive with amine or carboxylic end groups of the polymer under the conditions used for polymerizing the polymer.

We claim:

1. A self-crimpable nylon 66 yarn wherein said nylon 66 has an RV of at least 50 and contains from 0.02 to 0.5 mole %, based on the theoretical moles of nylon 66 repeat units, of chain branching agent and wherein said yarn has:

(a) an average denier per filament (dpf) of at least 13;
(b) a total denier of at least 750;
(c) an SAX equatorial/meridional ratio of at least 0.6;
(d) an elongation-to-break of less than 120%;
(e) a Bulk Test Value of at least 10%; and
(f) a Luster Test Value of at least 85%.

2. The yarn defined in claim 1 wherein said elongation-to-break is in the range of 30% to 90%.

3. The yarn defined in claim 2 wherein said dpf is in the range of 15 to 22.

4. The yarn defined in claim 3 wherein said total denier is in the range of 1200 to 2000.

5. The yarn defined in claim 4 wherein said Bulk Test Value is in the range of 12% to 45%.

6. The yarn defined in claim 5 having a relative viscosity of at least 70.

7. The yarn defined in claim 6 wherein said nylon 66 contains from 0.2 of 0.5 mole %, based on the theoretical moles of nylon 66 repeat units, of a chain branching agent.

8. The yarn defined in claim 7 wherein said Luster Test Value is at least 95%.

9. A self-crimpable nylon 66 yarn wherein said nylon 66 has an RV of at least 90 and contains from 0 to 0.5 mole %, based on the theoretical moles of nylon 66 repeat units, of chain branching agent and wherein said yarn has;

(a) an average denier per filament (dpf) of at least 13;
(b) a total denier of at least 750;
(c) an SAX equatorial/meridional ratio of at least 0.6;
(d) an elongation-to-break of less than 120%;
(e) a Bulk Test Value of at least 10%; and
(f) a Luster Test Value of at least 85%.

10. The yarn defined in claim 9 wherein said total denier is in the range of 1200 to 2000.

11. The yarn defined in claim 10 wherein said Bulk Test Value is in the range of 12% to 45%.

12. The yarn defined in claim 11 wherein said dpf is in the range of 15 to 22.

* * * * *